United States Patent [19]

Toramoto

[11] Patent Number: 4,995,836

[45] Date of Patent: Feb. 26, 1991

[54] PIN PLUG CONNECTOR

[75] Inventor: Hisao Toramoto, Kyoto, Japan

[73] Assignee: Hosiden Electronics Co., Ltd., Yao, Japan

[21] Appl. No.: 430,025

[22] Filed: Nov. 1, 1989

[30] Foreign Application Priority Data

Dec. 1, 1988 [JP] Japan ..... 63-157462[U]

[51] Int. Cl.[5] ..... H01R 17/18

[52] U.S. Cl. ..... 439/675; 439/578; 439/701

[58] Field of Search ..... 439/578–585, 439/675, 904, 905, 866, 867, 879, 891, 731, 752, 687, 701, 696

[56] References Cited

U.S. PATENT DOCUMENTS 1,872,678 8/1932 Chamberlain ..... 439/696

4,184,734 1/1980 Torell ..... 439/731

*Primary Examiner*—David L. Pirlot

*Attorney, Agent, or Firm*—Armstrong, Nikaido Marmelstein Kubovcik & Murray

[57] ABSTRACT

The inventive pin plug connector is advantageously applied to connection of a coaxial cable for electronics, in particular, in audio and video devices. The coaxial cable for such usage comprises a core conductive line, an insulative layer covering the core line, and an outer conductive line defined of networks knitted of thinned copper lines to cover the inner insulative layer. Conventionally, the prior job of taking the network outer line from the cable was needed, but troublesome. The inventive connector dispenses with this trouble, and the coaxial cable is permitted to be subjected to pin plug connection when the cable is stepwise peeled, and this connector comprises a pin, a terminal, and a body made of an insulative material, which will incorporate the pin and the terminal, and a cover which sheathes the body, wherein the pin is provided with devices for fitting the core line and the insulative layer, and the terminal is provided with devices for fitting the outer conductive line and for making a contact with a mating contact end of the cover.

3 Claims, 7 Drawing Sheets

PIN PLUG CONNECTOR

FIELD OF THE INVENTION

This invention relates to a pin plug connector which will be advantageously applied to electrical connections, particularly, connections in audio and video devices.

DESCRIPTION OF THE CONVENTIONAL ART

In reference to the conventional art, the drawings attached will be used. FIG. 8 shows a typical conventional art in perspective views, wherein FIG. 8 (*a*) shows a state that conductive lines contained in a cable are connected to a pin and a cover. FIG. 8 (*b*) shows a state that the pin is accommodated in a body opened. FIG. 8 (*c*) shows a state that the body is closed. FIG. 8 (*d*) shows a state that the pin, the body, and the cover are being assembled.

Proceeding with reference to the drawings above, the conventional pin plug connector is defined of the pin 71 made of a conductive material, the body 72 which is made of an insulative material and defined of two cylindrical halves connected with a hinge device 722, and the cover 73 which will sheathe around the body 72. And therein the cover 73 is provided with a contact end 731 and an engaging portion 732 to hold the body 72. The engaging portion 732 is provided with a hole cut 732*a* which will fit with a block 723 provided with the body 72, and with applying a caulking action to the body 72 at the portion 732, the assembly will be secured.

Therein, at the rear end of the pin 71, a core line 31 of the cable 80 is fitted, and, at the rear end of the cover 73, another conductive line 82 of the cable 80 is fitted.

However, disadvantages with the art noted above were found. First, the cover 73 which is to be mounted or assembled at the last step should be connected with the line 82 at the initial step, which caused troubles in the whole assembling process.

In particular, in the case where the cable 80 is a coaxial cable, a core line thereof should be fitted to the pin 71 and an outer line should be fitted to the cover 73. Then, it is to be noted that the outer line is made of a network knitted of thinned copper lines which covers around the inner insulative layer, which requires a troublesome job as preliminary step of taking the end of the outer network line from the insulative layer. Alternatively, if the end of the outer line is cut to make a free end, the network lines are broken into pieces, which will lose reliability as the conductor and further such a cut one is not easily fitted into the cover 73.

SUMMARY OF THE INVENTION

The present invention is devised to overcome such disadvantages found with the conventional art and offers the new art, in which a cable having a core line and an outer network line with an insulative layer inbetween is permitted to be subjected to a mounting job to a pin plug connector without taking priorly the outer line from the inner insulative layer and without fitting the outer line to the cover, which will bring about the simple and trouble-free assembly.

The present invention is summarized as follows: a pin plug connector for connecting a cable having a core conductive line, an insulative layer covering the core line, and an outer conductive line laying outwardly of the insulative layer: said pin plug connector comprises;

a terminal, a pin which is connected to the terminal, a body, made of an insulative material, in which the core line is connected to the pin and the outer conductive line is connected to the terminal, and a cover which sheathes the body to connect to the outer conductive line; wherein the pin is provided with devices for fitting the core line and the insulative layer, and the terminal is provided with devices for fitting the outer conductive line and for making a contact with a mating contact end of the cover, whereby the core line is conducted to the pin end and the outer line is conducted to the cover, the insulative layer is ended the terminal.

BRIEF DECRIPTION OF THE DRAWINGS

FIGS. 2 to 6 show, in series, views similar to FIG. 1 to indicate the process for assembling the components as shown in FIG. 1, wherein:

Figure 2:
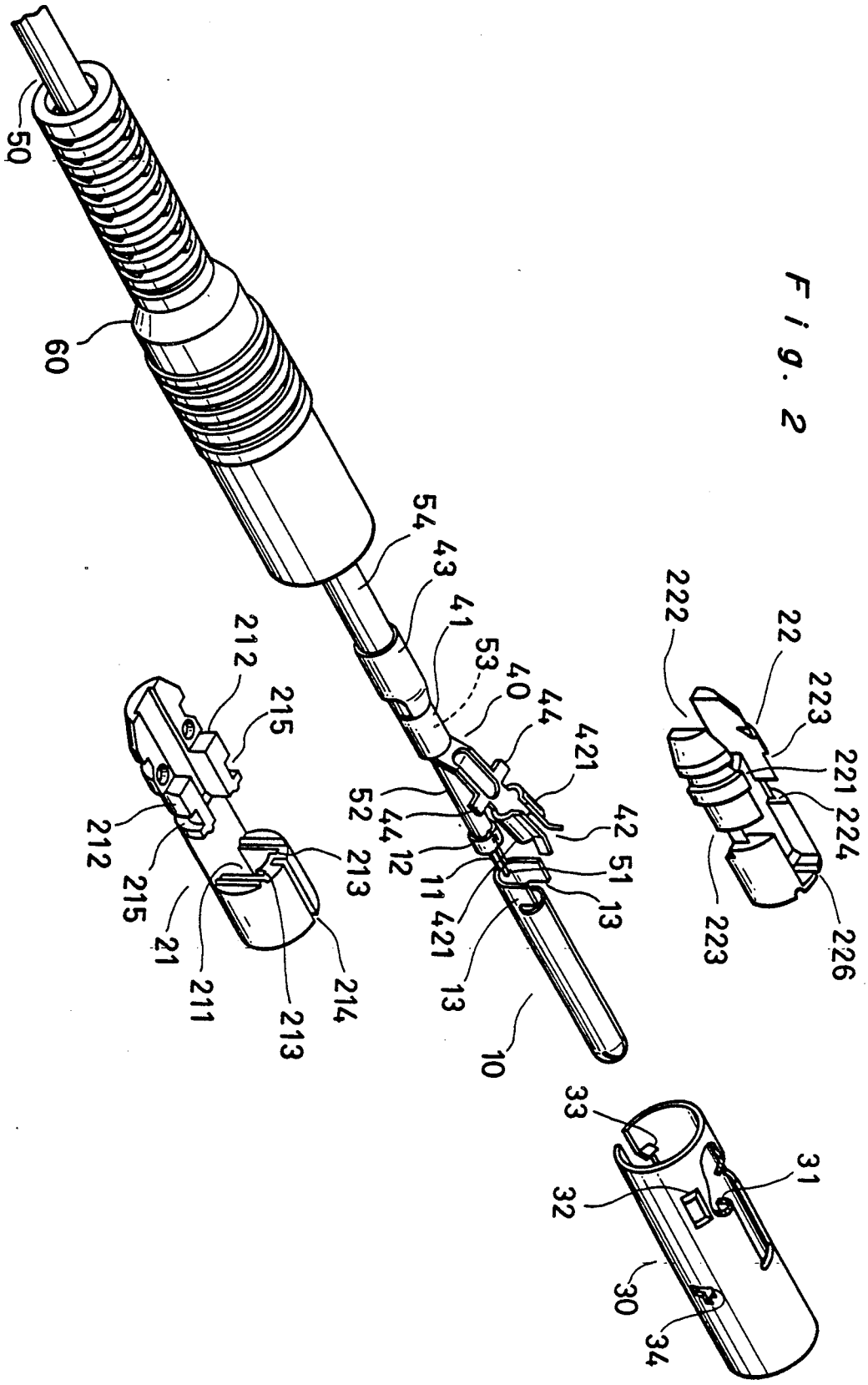
Figure 3:
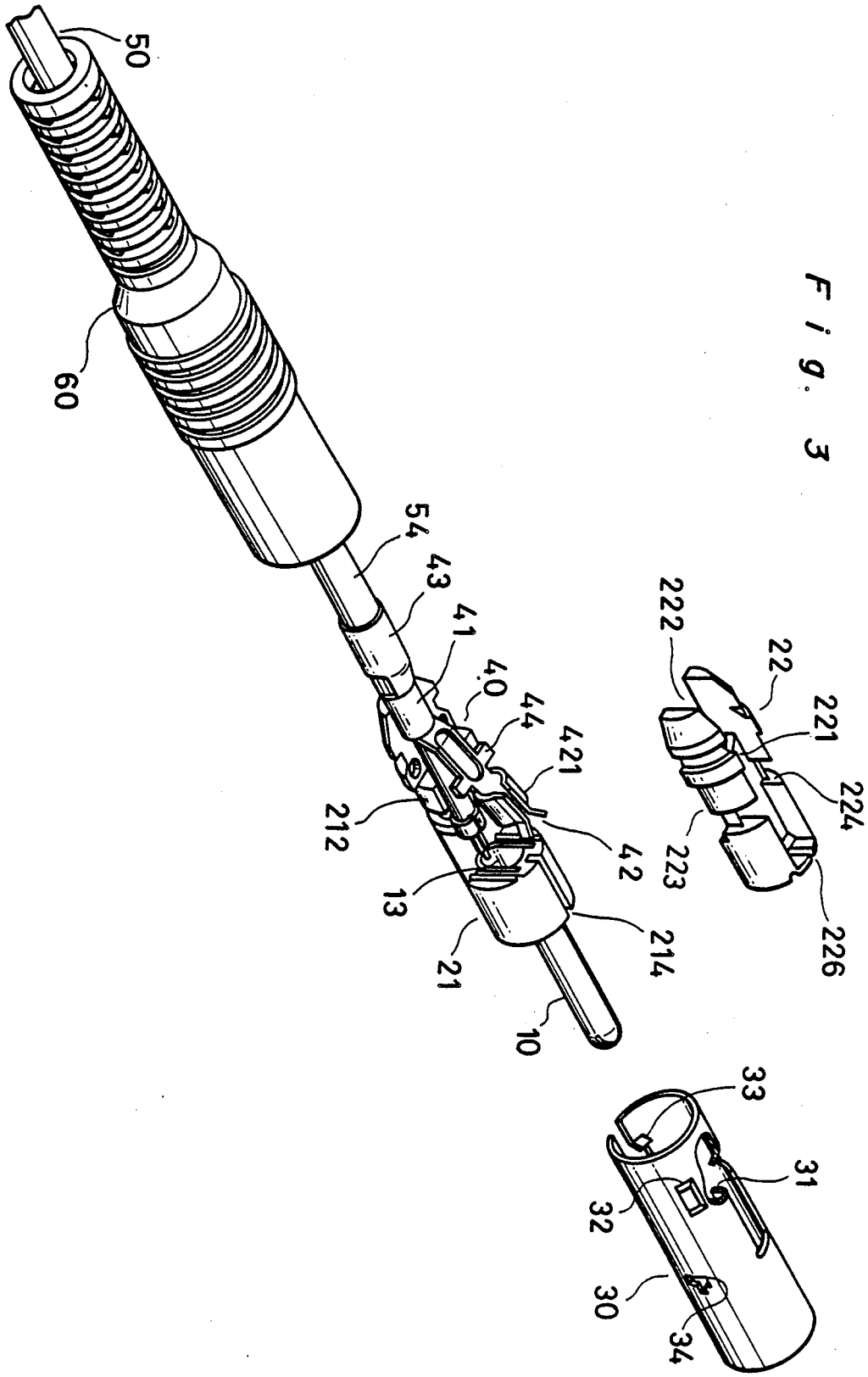
Figure 4:
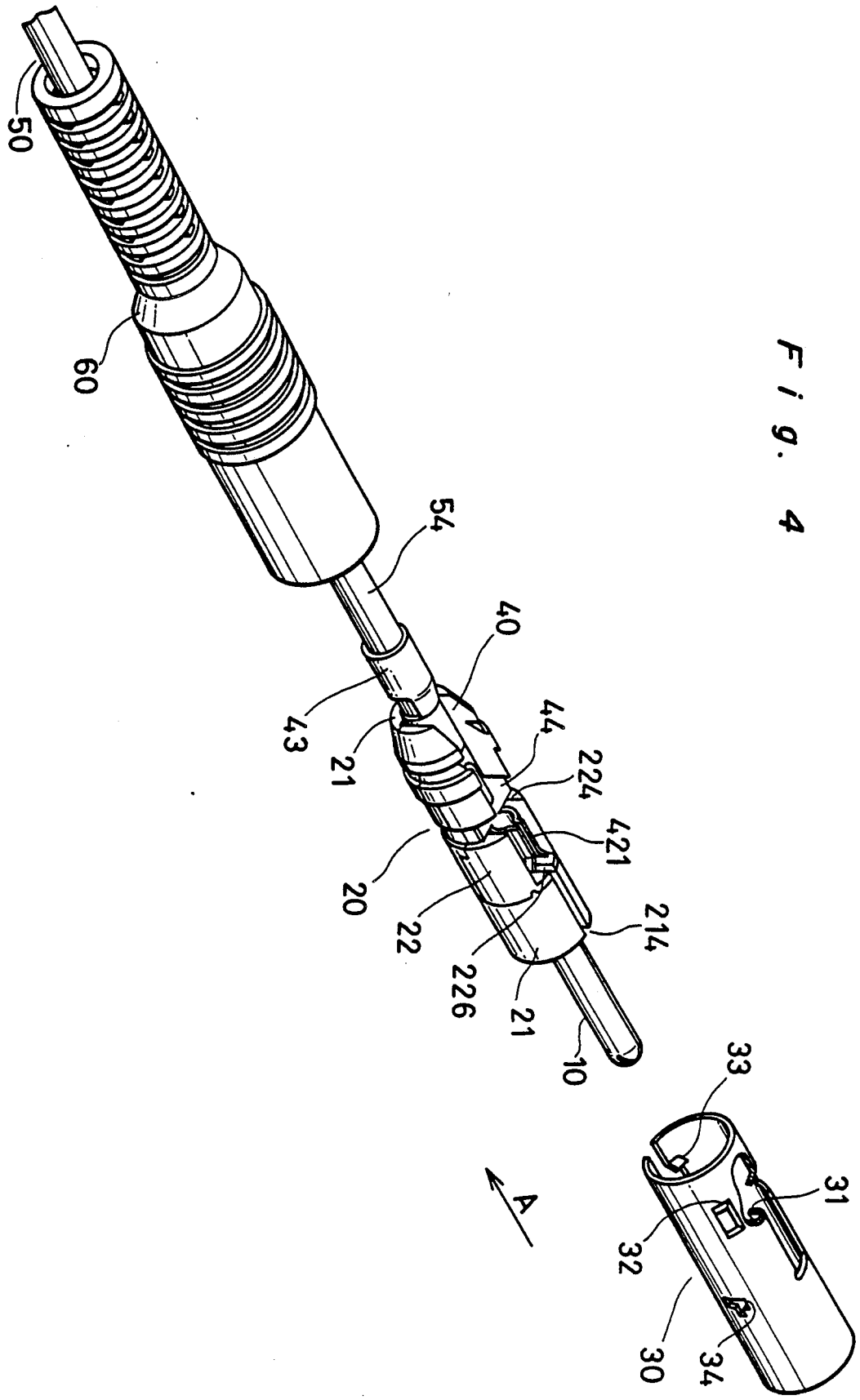
Figure 5:
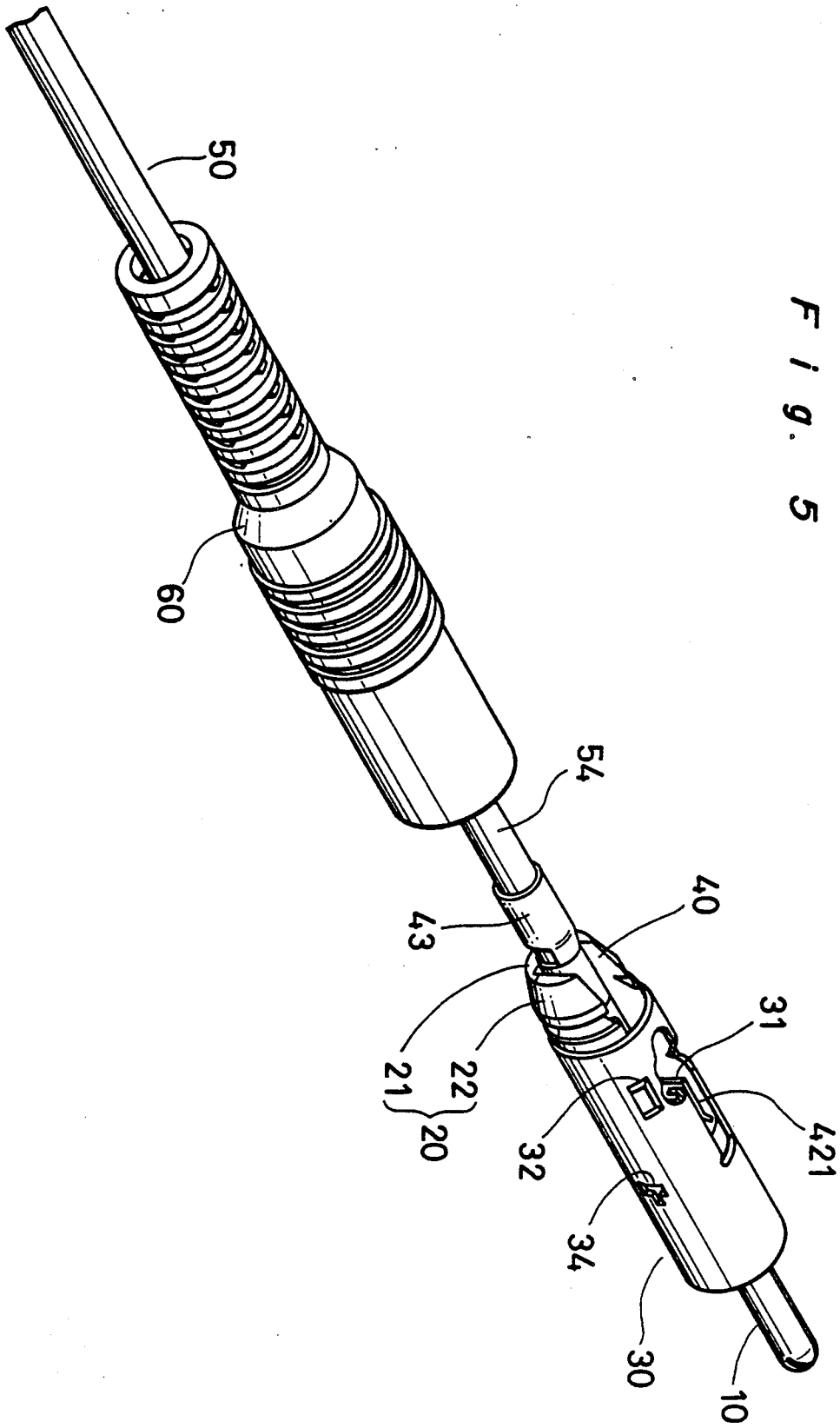
Figure 6:
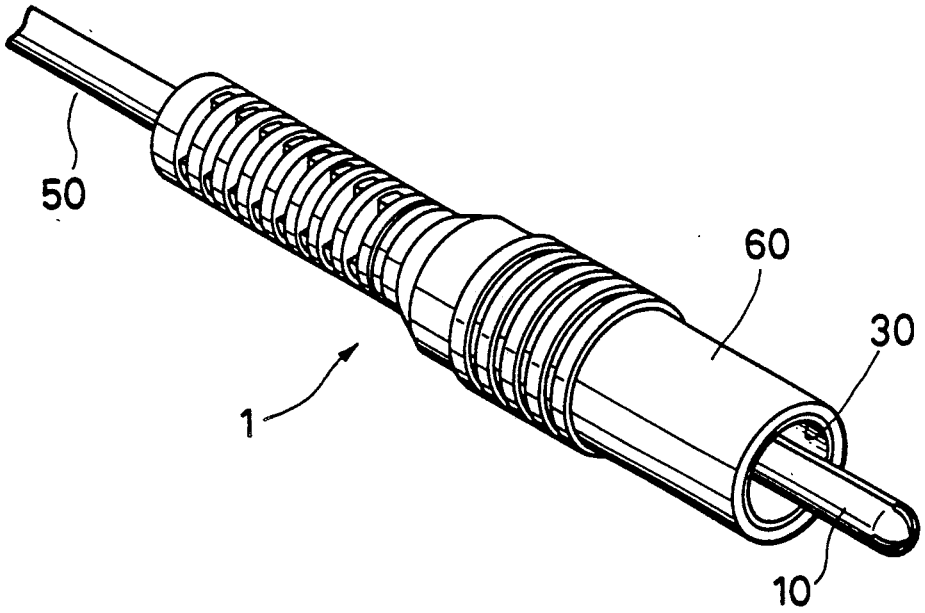

FIG. 2 shows a state that a cable is fastened with a terminal and a pin. FIG. 3 shows a state that a first body half is fastened. FIG. 4 shows a state that a second body half is fastened. FIG. 5 shows a state that a cover is applied. FIG. 6 shows a state that a cap is fitted.

Figure 7:
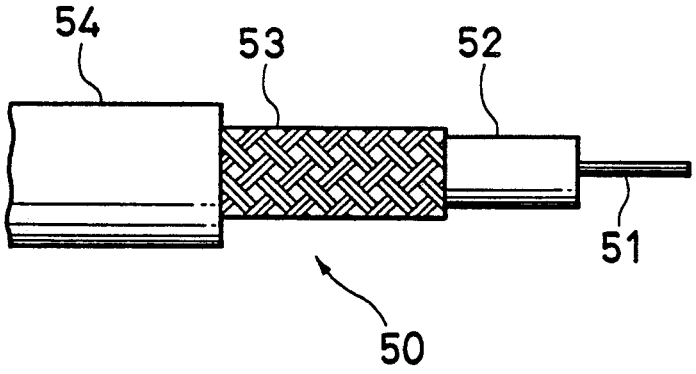
Figure 8A:
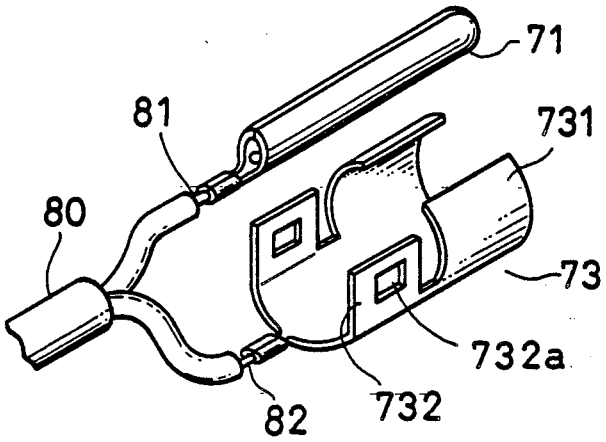
Figure 8B:
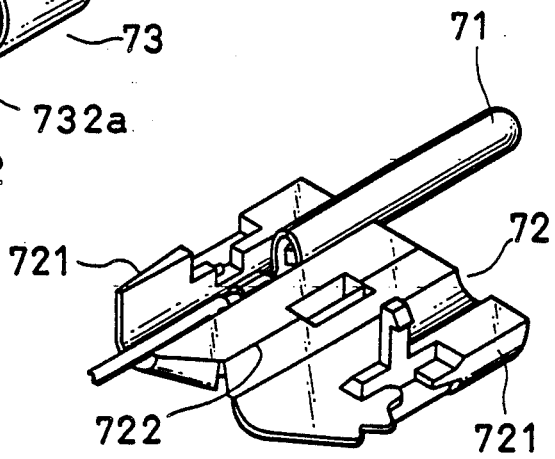
Figure 8C:
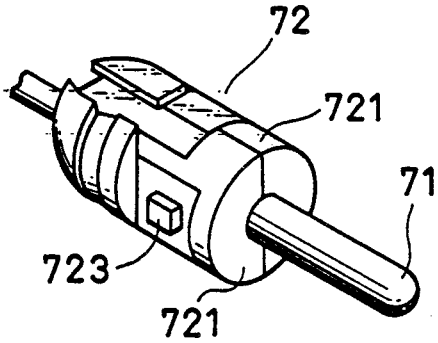
Figure 8D:
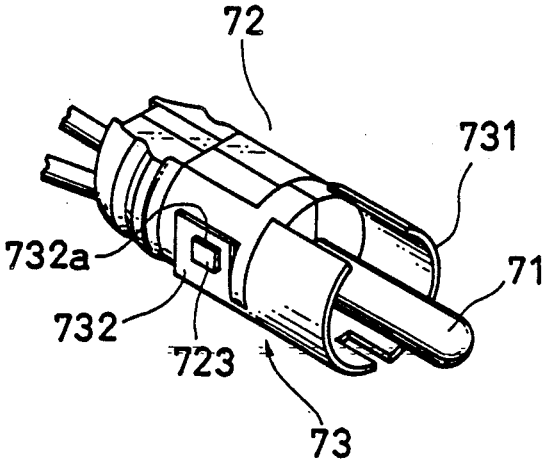

FIG. 7 shows a side view of a cable having a coaxial structure.

FIG. 8 shows, in a series of (a) to (d), a conventional pin plug connector, wherein:

FIG. 8 (*a*) shows a state that a conductive line comprised in a cable is fastened to a pin and a cover. FIG. 8 (*b*) shows a state that the pin is received in a body. FIG. 8 (*c*) shows a state that the body is closed. FIG. 8 (*d*) shoes a state that the pin, the cover, and the body assembled as noted before.

These drawings are presented to illustrate the invention and a conventional art. Therefore these should not be construed as limiting the invention.

DESCRIPTION OF THE INVENTIVE EMBODIMENT(s)

The invention will be explained in the following with reference to the drawings.

As shown in FIG. 7, a coaxial 50 comprises a core conductor line 51, an insulative layer 52, made of polyethylene, for instance, which sheathes or covers around the core line 51, an outer conductor line 53 which is defined of cylindrical network knitted of thin copper lines, and a protective sheath 54 which covers insulatively around the outer conductor 53. And normally a coaxial cable 50 is applied to fastening, as shown in FIG. 7, to a pin plug connector in a state that its core line 51, insulative layer 52, and outer conductor 53 have been subjected in stepped peeling treatment.

In the embodiment herein, a coaxial cable brought in the stepwise peeled state will be applied to a pin plug connector.

A pin plug connector 1 as illustrated FIGS. 1 to 6 comprises: a body 20 (see FIG. 4 and, as will be apparent later, the body 20 is defined of two halves 21, 22. See FIG. 1), made of insulation; a pin 10, made of metal, which will connect with a terminal 40, made of metal, the connection being received in the body 20; a cover 30 in a generally cylindrical form to sheathe the body 20, wherein at one end of the pin 10, a core press-fitter 11 is formed to press-fit a core line 51 of a coaxial cable 50, and the terminal 40 is at its one end formed with an outer press-fitter 41 to press-fit an outer line 53 and is, at the other end, formed with a connecting end 42 to fit with a mating end 31 formed on the cover 30, as will be apparent later.

Figure 1:
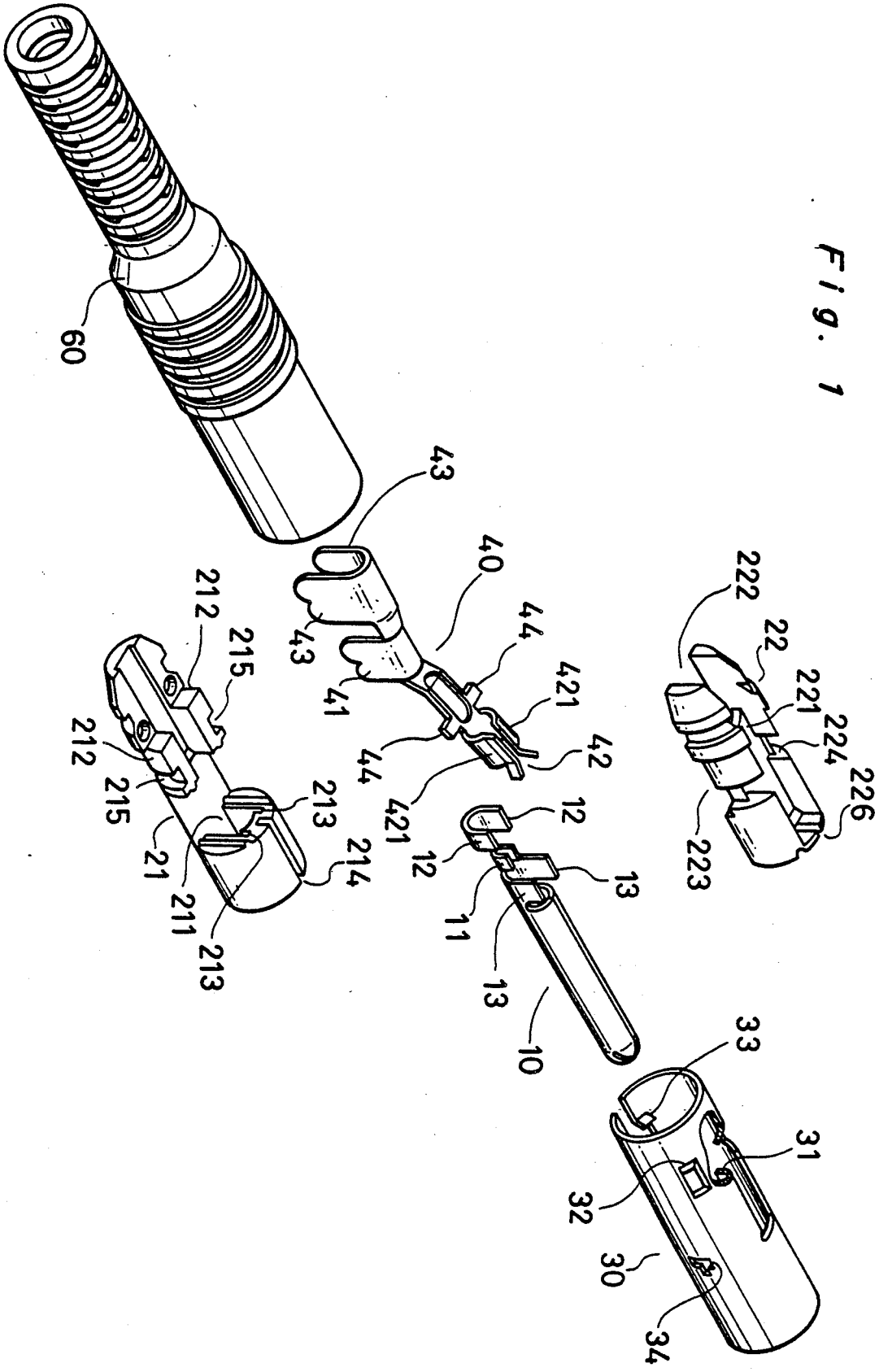
FIG. 1 shows an exploded perspective view of components with a partial break which will partake to form the inventive pin plug connector.

The electrically conductive pin 10 is formed at its forward end with a round end and, at its reaward end, in addition to the press-fitter 11 as noted above, formed with an insulator clamper 12 to clamp the insulative layer 52 of the coaxial cable 50, each being shaped generally in a pair of stands. Whereby the pin 10 will clamp the end of the insulative layer 52 by the clamper 12 and connect to the core line 51 by the press-fitter 11. Additionally, the numeral 13 in FIG. 1 is a drag or detent to avoid self-turning tendency of the pin 10 after received in the body 20.

The electrically conductive terminal 40 is assigned to have a function of connecting the cover 30 to the outer line 53 of the cable 50, and therefore, at its rear end, a clamper 43 is formed to clapm the end of the sheath 54 of the cable 50, in addition to the press-fitter 41 as noted above, and each being formed with a pair of stands, and at its forward end, the connecting end 42 is formed as noted above. This terminal 40 is connected to the cable 50 with aid of press-fitting of the outer conductor 53 by the press-fitter 41 and also of clamping of the sheath 54 by the clamper 43. Inbetween the connecting end 42 and the press-fitter 41 on the terminal 40, a pair of lateral blocks 44 are formed so as to engage to a pair of cuts 224 of a second body half 22 that will be appear later. Said connecting end 42 comprises a pair of round stands 421 so as to hold the mating connecting end 31 of the cover 30.

The body 20 is defined of the first half 21 which will be inserted by the pin 10, and the second half 22 which will be fitted by the terminal 40. These two halves being, made of an insulative material, configured by combination to form generally a cylindrical shape.

Referring to the first half 21, a hole 211 to be inserted by the pin 10 is formed with this half 21, and at upper sides of the hole 21, a pair of grooves 213 are formed to avoid self-turning thereof so that, on insertion of the pin 10, the pair of the drags 13 will fit into the grooves 213, thereby the pin will have no play to turn after the insertion. Further, on the upper face of forward end of the first half 21, a groove 214 running longitudinally is formed so that, on assembling the cover 30 with the body 20 as will appear later, the groove 214 will act as a passage of the connecting end 31 of the cover 30. Still further, the first half 21 is formed, at a middle portion thereof, with a pair of side walls 212 having a recess 215 each side.

Referring to the second half 22, an upper groove 221 to receive the terminal 40 and a lower groove 222 in which the ending portion of the insulative layer 52 of the cable 50 will be located are formed longitudinally of the second half 22, the grooves 221, 222 of the second half 22 being positionally asigned on opposite sides with a diametric plane inbetween. At midportions of a pair of walls configured at the groove 221, a pair of cuts 224 are formed so that the pair of the blocks 44 of the terminal 40 will engage to these paired cuts 224. Further, an end groove 226 is formed at the forward end of the second half 22 so that, on assembling of the cover 30 to the body 20, the connecting end 31 of the cover 30 will be allowed to pass through. Still further, said pair of the walls are thinned outwardly of the walls at portions 223, which will engage to the wall portion 212 of the first half 21 when two body halves 21, 22 are coupled.

The electrically conductive cover 30 is shaped to have a generally cylindrical form and will sheathe around the body 20 (the body 20 means the status after coupling of the two halves 21, 22) and will connect to the terminal 40 which is fastened in the second half 22, wherein the connecting end 31 of the cover 30 is shaped to be an end projecting inward as is seen through a break in FIG. 1, and accordingly, the end 31 will fit in space between a pair of hands 421 thereby to form a contact to the end 42, thus the terminal 40 and the cover are connected. Additionally, the cover 30 is provided with flaps 32, 33 to make a contact each with the recess 224 of the second half 22 and the recess 215 of the first half 21. A flap 34 on the cover 30 is adapted to act as a stop in applying the cover 30 around the body 20 to control the sheathing.

A component 60 is a cap, made of insulative resin, to shield the assembled pin plug connector 1.

Referring to the process of assembling the inventive pin plug connector.

First, the coaxial cable 50 is priorly subjected to peeling to form a stepwise peeled end as shown in FIG. 7.

Then, as shown in FIG. 2, the cable 50 is inserted into the cap 60 and ends of the core line 51 and the insulative layer 52 are fitted by the press-fitter 11 of the pin 10 and the clamper 12 respectively, and the outer conductor 53 (unapparent in FIG. 2) and the sheath 54 of the cable 50 are likewise fitted by the press-fitter fitter 41 and the clamper 43. Thereby, the pin 10 and the terminal 40 are connected to the cable 50, wherein the core line 51 is thus conductive to the pin 10 and the outer conductor 53 is also to the terminal 40.

Next, as shown in FIG. 3, the pin is inserted into the hole 211 provided with the first half 21 with concurrent fittings of the drags 13 of the pin 10 to the grooves 213 of the first half 21, thereby the cable 50 being connected to the first half 21.

Then, as shown in FIG. 4, the second half 22 is coupled with the first one 21, wherein the second half 22 receives the insulative layer 52 into its groove 222 and also the connecting end 42 of the terminal 40 into its groove 221, and then, the blocks 44 are engaged with the cuts 224, thereby connection of the cable 50 to the pin 10 and the terminal 40 and also coupling of the first half 21 with the second one 22 being finished.

Then, the cover is translated along the arrow line in FIG. 4 to sheathe over the coupled body 20, with additional engagements of the end 31 of the cover 30 to the connecting end 42 of the terminal 40 after having passed the groove 214 of the first half 21 and the groove 226 of the second half 22, wherein the end 31 is finally held by the pair of the hands 421, thus the terminal 40 is connected to the cover 30, which follows that the outer conductor 53 of the cable 50 is now connected to the cover 30, wherein concurrently the flaps 32, 33 are respectively engaged to the cuts 224 of the second half 22 and the recesses 215 of the first half 21.

FIG. 5 shows a state that the cover 30 is going to mount over the body 20.

Lastly, as shown in FIG. 6, the cap 60 is moved to cover the pin plug assembly to finish the outstasnding process.

In the description above, a coaxial cable is employed to represent the invention, but other kinds of cables having an outer conductor line defined of networks of thinned copper lines, shield cables, for instance, are applicable to this invention.

What is claimed is:

1. A pin plug connector for connecting a coaxial cable having a core conductive line, an insulative layer covering the core line, and an outer conductive line lying outwardly of and around said insulative layer and around said conductive core, comprising:

a body of an insulative material;

a cover disposed in surrounding relation to said body and being connectable electrically with said outer conductive line;

a pin connectable with said core conductive line, said pin comprising a first press fitting means for press fitting around said core conductive line and clamping means for clamping around said insulative layer;

a terminal connectable with said outer conductive line and said cover, said terminal comprising second press fitting means for press fitting around said outer conductive line, said insulative layer and said core conductive layer and in electrical contact with said outer conductive line, said terminal including connecting end means for connecting with a mating end, of said cover;

said body comprising means for receiving said pin and said terminal therein such that said cover is slidable over said body for connecting said connecting end means on said terminal with said mating end on said cover.

2. A pin plug connector according to claim 1, wherein said body comprises first and second halves fitted together, said first half having a hole therein for receiving said pin, said second half having a groove therein for receiving said terminal.

3. A pin plug connector according to claim 2, wherein said first half further has a longitudinal groove for slidably receiving said mating end of said cover.

* * * * *